US007204770B2

(12) United States Patent
Mithieux

(10) Patent No.: US 7,204,770 B2
(45) Date of Patent: Apr. 17, 2007

(54) TABLE TENNIS RACKET

(75) Inventor: Stéphane Mithieux, Breteuil (FR)

(73) Assignee: Etablissements Cornilleau, Bonneuil les Eaux (FR)

( * ) Notice: Subject to any disclaimer, the term of this patent is extended or adjusted under 35 U.S.C. 154(b) by 0 days.

(21) Appl. No.: 11/333,237

(22) Filed: Jan. 18, 2006

(65) Prior Publication Data

US 2006/0160641 A1 Jul. 20, 2006

(30) Foreign Application Priority Data

Jan. 20, 2005 (FR) ..... 05 00576

(51) Int. Cl.
*A63B 59/04* (2006.01)

(52) U.S. Cl. ..... 473/527

(58) Field of Classification Search ..... 473/524, 473/527, 529, 530

See application file for complete search history.

(56) References Cited

U.S. PATENT DOCUMENTS 3,879,035 A * 4/1975 Danchulis et al. ..... 473/527
3,879,250 A * 4/1975 Rankin, Jr. ..... 156/228
3,934,876 A * 1/1976 Haddad ..... 473/527
4,128,239 A * 12/1978 Grenadier ..... 473/530
5,961,404 A * 10/1999 Gormley ..... 473/530
2006/0160641 A1* 7/2006 Mithieux ..... 473/527

FOREIGN PATENT DOCUMENTS

| | | |
|---|---|---|
| DE | 18 00 672 | 6/1970 |
| DE | 20 07 740 | 9/1971 |
| FR | 802 060 | 8/1936 |
| GB | 2 151 931 | 7/1985 |

* cited by examiner

*Primary Examiner*—Raleigh W. Chiu
(74) *Attorney, Agent, or Firm*—Young & Thompson

(57) ABSTRACT

The present invention relates to a table tennis racket comprising a core of synthetic material and a covering fitted onto said core by overmolding or by co-molding. According to the invention, the core is in the form of a single piece presenting a tubular handle and a paddle of thickness that is smaller than the smallest outside diametral dimension of the tubular handle, and it is provided with a plurality of recesses, between them defining a plurality of partitions extending perpendicularly to the plane of the paddle.

7 Claims, 2 Drawing Sheets

TABLE TENNIS RACKET

The present invention relates to a table tennis racket presenting a structure adapted to low-cost manufacture.

BACKGROUND OF THE INVENTION

The structure of a traditional table tennis racket is relatively simple. It comprises a paddle generally made of wood having the same outline as the racket, including its handle. Handle sections are applied by means of adhesive to each of the faces of the paddle so as to impart volume to the handle portion and reinforce the seating of the handle relative to the paddle, and a covering is stuck onto each of the two faces of the playing portion, generally a single- or multi-layer elastomer coating.

The quality of the racket depends mainly on the quality of each of the elements making it up and on the quality of the assembly. Present manufacture of such rackets still includes numerous manual operations that are a factor contributing to high cost price, which makes it necessary to look for the least expensive work force possible, off-shore.

That is why attempts have been made to automate the manufacture of this instrument to as great as extent as possible and quite naturally investigation has been directed towards plastics technology in an attempt to manufacture by injection-molding.

An illustration of such techniques is to be found in patent document ES 2 024 413 which discloses a racket having a core made of molded plastics material, reinforced where necessary with Kevlar (registered trademark) fibers extending from the end of the handle to the opposite end of the paddle. Injection-molding is then used to cover the core in a polyurethane foam for which a skin-effect is desired so that the racket presents a playing surface that is smooth or to which an additional surface treatment has been applied in order to obtain a playing surface that is smooth.

In reality, such rackets have not enjoyed any commercial success since either they are too flexible making them practically "unplayable", or else they are too heavy and are quickly discarded by players. In order to obtain sufficient stiffness, it is necessary to use considerable thicknesses of material optionally reinforced by optionally oriented fibers. And, in order to obtain results that are acceptable in terms of ball-racket contact, covering the paddle in a polyurethane foam is not appropriate.

It has therefore been necessary to create a racket structure that differs from that of existing rackets, both concerning the core thereof and concerning the covering, in order to enable conventional plastics technology to produce results that are satisfactory, and that enjoy the intrinsic benefit of such technology, namely a manufacturing cost that is low.

OBJECT OF THE INVENTION

It is in this context that the present invention proposes a novel racket structure.

BRIEF SUMMARY OF THE INVENTION

To this end, the invention provides a covering for a table tennis racket that is formed by a layer of elastomer having an outside face that is structured to present adjacent open cells.

One of the functions of the cells is to form a volume which, on being closed by a ball making contact with the racket, constitutes a set of individual gas springs that adds its effects to that of the elastomer, but without any increase in weight.

This covering can be fitted onto any medium forming the core of the racket and made of any material, and in particular on a paddle made of wood, and it may be fitted thereto either directly, or else via an intermediate covering.

In the course of experimentation, it has also been found that it is advantageous to provide cells, providing they are blind, in which the partitions defining them present in their tops at least two channels for connecting the inside volume of one cell to the inside volumes of each of at least two adjacent cells. It has been found that by these means the noise made by the ball impacting the racket is improved in the sense that it is made more similar to that which is expected in the game of table tennis.

Finally, experiments have also shown that it is possible to adjust the characteristics of the racket concerning its contact with the ball by modifying the shape, the size, and the distribution of the cells, either within a single covering so as to define different playing areas on a face of the racket that presents varying responses, or else between the two faces of a racket.

Naturally, the preferred application of this covering is in association with a racket core obtained by molding, overmolding, or co-molding, in a suitable injection mold. Thus, in a preferred embodiment of the core, it is in the form of a single piece comprising a tubular handle and a paddle of thickness that is smaller than the smallest outside diametral dimension of the handle, and that is provided with a plurality of recesses defining between them a plurality of partitions that are perpendicular to the plane of the paddle, the above-mentioned recesses being formed so as to constitute blind recesses in the thickness of the paddle opening out in the peripheral edge face thereof, and having their closed ends close to a solid central core of the paddle situated in line with the sleeve.

This structure enables the core to be made by molding a plastics material without that penalizing the racket by increasing its weight, and without degrading its mechanical qualities compared with those of a wooden core. This structure retains stiffness that is very similar to that of a wooden racket.

In addition, having a handle that is tubular, i.e. hollow, makes it possible to receive in the handle one or more inserts serving to modify or adjust weight distribution and thus the sensation of balance in the hand of the player.

Under such circumstances, in addition to the partitions between the peripheral recesses that extend substantially radially in the thickness of the paddle, the paddle also presents two parallel solid surfaces as in a conventional wooden racket, each suitable for receiving the above-specified covering and forming an acceptable compromise between the amount of material used to make a molded racket without affecting its weight, and obtaining ball-contact quality that is satisfactory for an experienced player.

Other characteristics and advantages of the invention appear from the following description of several embodiments.

BRIEF DESCRIPTION OF THE DRAWINGS

Reference is made to the accompanying drawings, in which.

DETAILED DESCRIPTION OF THE INVENTION

Figure 1:
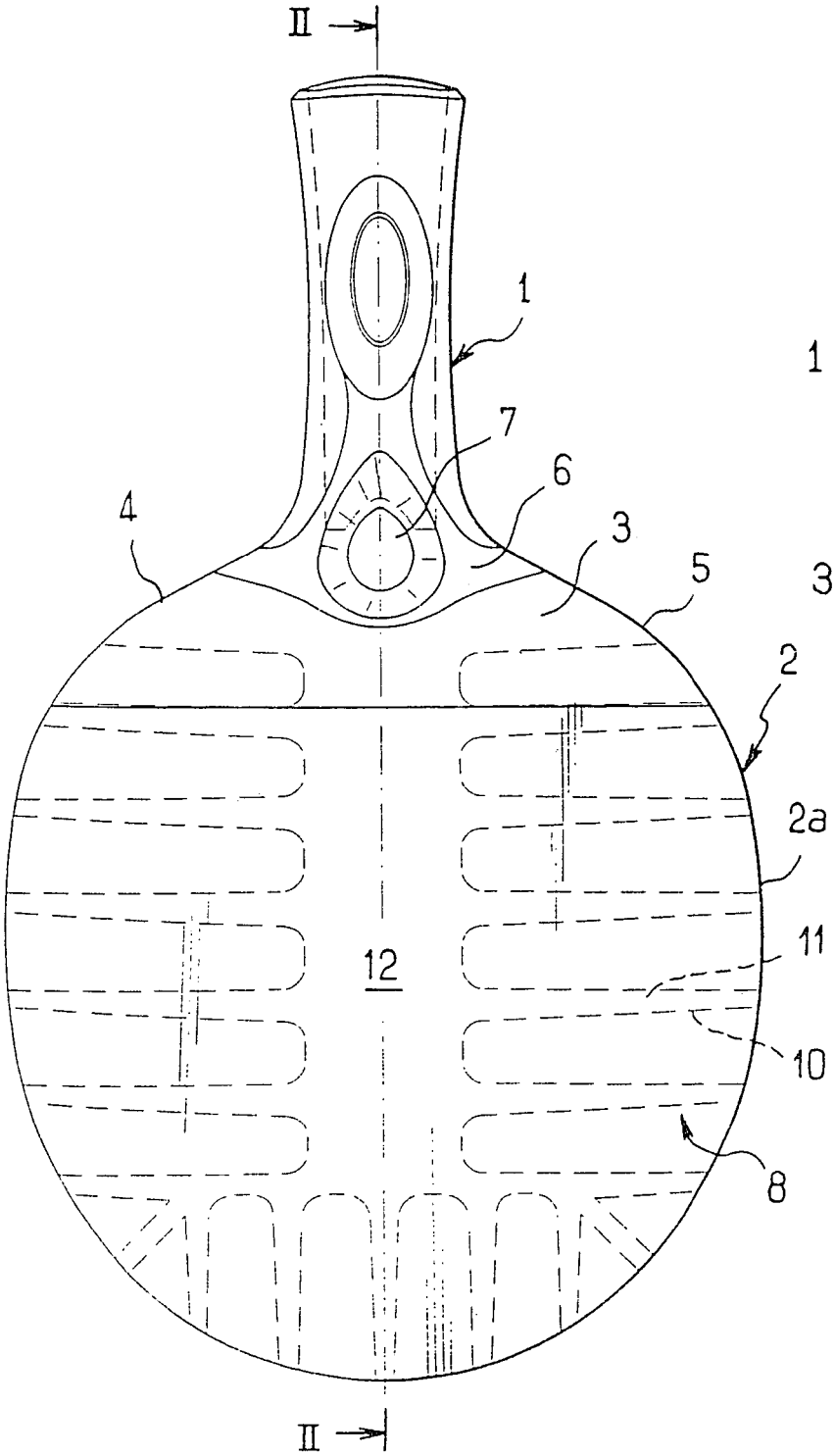
FIG. 1 is a plan view of a core for a racket in accordance with the invention obtained by an injection-molding process.
Figure 2:
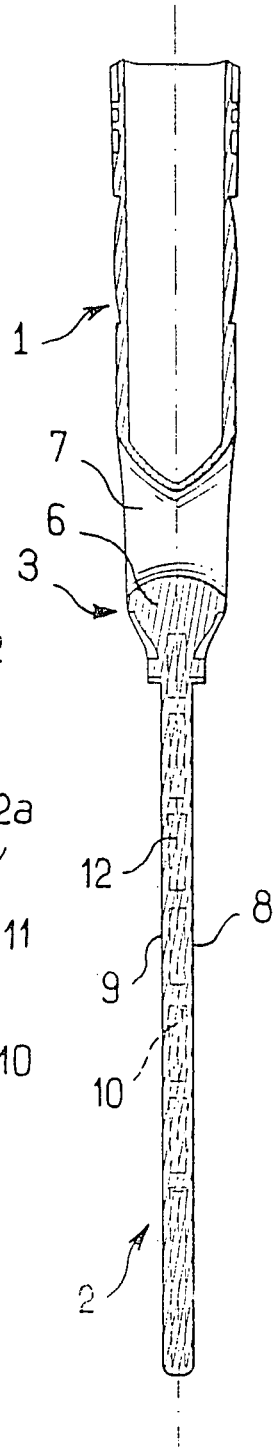
FIG. 2 is a section view on line II—II of FIG. 1.

The plastics material core of the racket of the invention shown in FIGS. 1 and 2 comprises a tubular handle 1 of substantially elliptical section with its major axis lying in the plane of FIG. 1, and a paddle 2 of a shape that is approximately circular, as is usual in this field. The paddle is connected to the handle 1 via a solid transition zone 3 of thickness that increases, flaring towards the handle from two portions 4 and 5 of the peripheral edge of the paddle adjacent to the handle 1, so as to constitute a solid seating 6 for the handle in the paddle, said seating being hollowed out by a through orifice 7 of hourglass shape.

The paddle 2, defined by its peripheral edge 2*a* extended by the above-described portions 4 and 5, has two faces 8 and 9 between which there are formed a plurality of blind recesses 10 opening out into the edge face 2*a*, 4, and 5 of the paddle. These recesses define between them partitions 11 that extend perpendicularly to the faces 8 and 9 of the paddle, and that are of shapes and positions such as to enable the molding cores used for making them to be unmolded easily. It should be observed in the present case that the blind end of each of these recesses is close to a solid central portion 12 of the paddle that lies in line with the handle 1 and that contributes to stiffening it.

Naturally, the material used for making this structure is selected as a function of the weight and the strength that are to be obtained. In particular, in rackets of good quality, provision is made to inject a plastics material that is filled, e.g. with fibers, so as to enable its modulus of elasticity to be controlled.

In order to finish off such a racket, it is necessary to cover the faces 8 and 9 in an elastomer that confers the ball-contact qualities on the racket.

Figure 6:
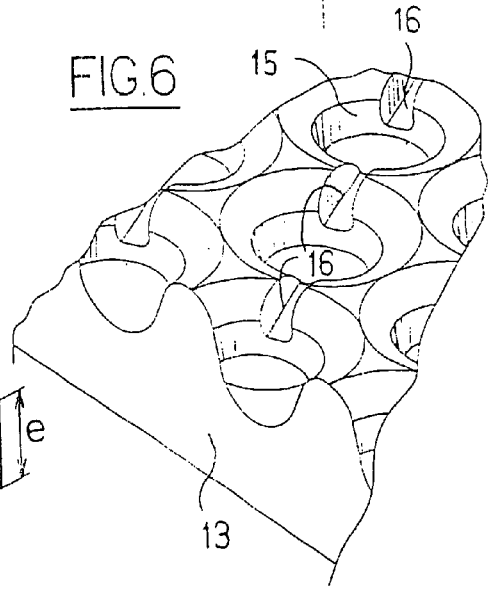
FIG. 6 is a view showing a variant embodiment of the covering.
Figure 5:
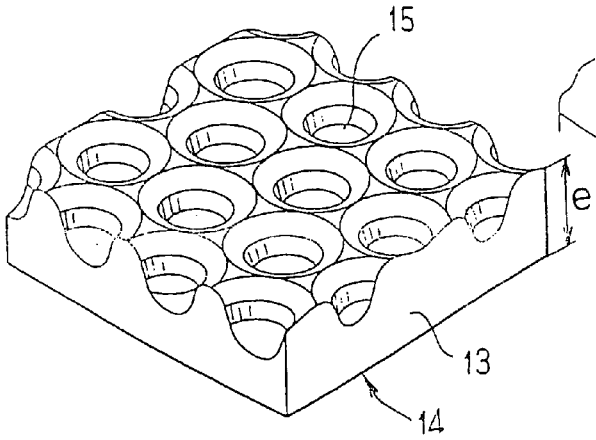
FIG. 5 is an isometric view showing the form of a covering in accordance with the invention.

FIGS. 5 and 6 shows the covering for putting into place on the two faces of the paddle. As can be seen in FIG. 5, it comprises a covering 13 of thickness ethat is of the order of 2 to 3 millimeters, presenting a smooth bottom surface 14 for coming into contact with and being bonded to one of the faces 8 and 9 of the paddle, and a top face into which there open out a plurality of adjacent cells 15, each cell being defined in this example by a circular bead with a rounded top edge that is adjacent to or melds in with the bead defining each of the six contiguous cells. The cells may be of a shape that is different from that shown, with the shape shown corresponding to the cells being distributed regularly and isotropically over the entire surface of the racket so that the action of the racket on a ball is identical regardless of the point of impact of the ball. It is possible to provide cells having other shapes (hexagonal, square, rectangular, . . . ) and for the shapes and the distribution of the cells to be quite different from a regular shape and distribution, thereby making it possible by experimentation to give the racket playing areas that present differing qualities. It is also possible to fit coverings having different kinds of cell on each of the two faces of the racket.

The least expensive technique for preparing the covering consists in co-molding or overmolding the material of the covering on a core as shown in FIGS. 1 and 2. It is also possible in accordance with the invention to produce covering plates by molding them, and subsequently to fit the coverings on any racket by any suitable means. The covering can have a thickness e that is relatively small given the above-mentioned effect, i.e. the gas spring effect produced by the air contained in the cells and imprisoned by a ball at the moment of impact.

FIG. 6 shows channels 16 interconnecting adjacent cells through the tops of the partitions between them. It has been found by experiment that the noise of the ball impacting against the racket can be disconcerting for players used to conventional rackets. On impact, or at least at the beginning of impact, these channels act to provide leakage paths for the air held captive in each cell involved with the impact, the paths leading to one or two adjacent cells, and it is believed that this avoids a film of air being created between the ball and the tops of the cell partitions, because the air in each of the cells can leak out under the effect of an impact, thereby leading to the covering coming into contact with the ball in a manner that is more clear-cut, at least at the beginning of the impact.

Figure 3:
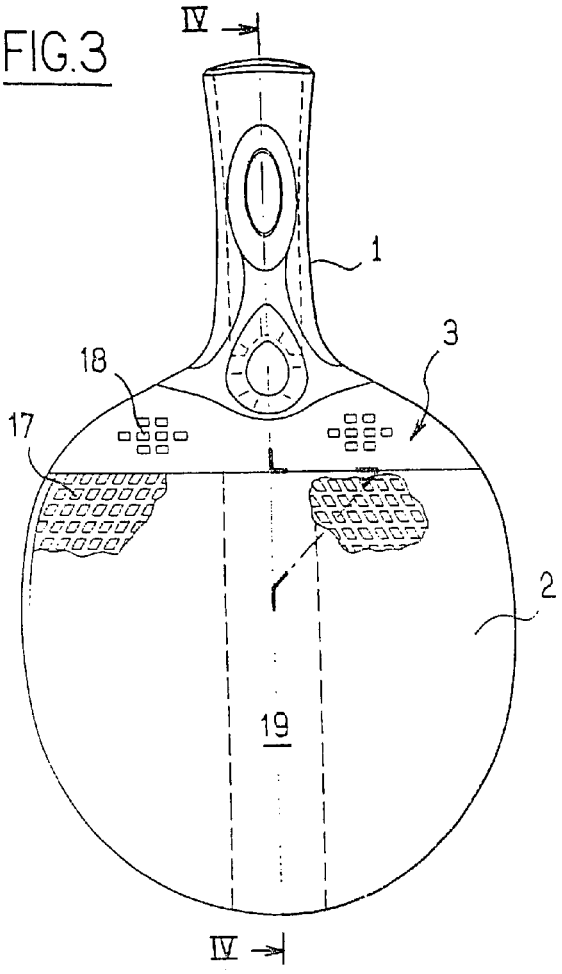
FIG. 3 is a view of a variant embodiment of the core structure for a racket in accordance with the invention.
Figure 4:
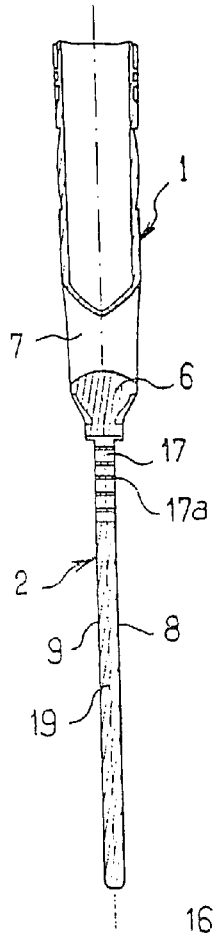
FIG. 4 is a section view on broken line IV—IV of FIG. 3.

FIGS. 3 and 4 show a variant embodiment of the core of a racket in accordance with the invention that can likewise be made by injection-molding. The racket has through orifices 17 extending through the thickness of the racket between its two faces 8 and 9 and opening out in said two faces in such a manner as to define an array of partitions 17*a* perpendicularly to said two faces. These partitions impart acceptable stiffness to the racket, while the orifices they define are a factor contributing to reducing the weight of the racket. Orifices 18 can also be provided in the zone 3 where the paddle 2 joins the sleeve 1.

In accordance with the invention, the distribution of the orifices 17 and 18 over the racket can be determined by experiment and as a function of the qualities that it is desired to obtain, and in particular, it is possible, as in the above embodiment, to maintain a non-perforated central portion 19 in line with the handle 1.

Any kind of appropriate covering can be fitted to this racket, and in particular the covering of FIGS. 5 and 6, either by adhesive or indeed by overmolding or co-molding, in which case the elastomer material will fill the orifices 17 completely or in part.

What is claimed is:

1. A table tennis racket comprising a core and a covering fitted on the core by overmolding or by co-molding, wherein the fitted covering is formed by a layer of elastomer presenting an outside face that is structured to present adjacent open cells.

2. A racket according to claim 1, wherein each cell is defined by a partition presenting in its top at least two channels for connecting the inside volume of the cell to the inside volume of each of at least two adjacent cells.

3. A racket according to claim 1, wherein the shapes, the sizes, and the distributions of the cells are regular and identical on both faces of the core.

4. A racket according to claim 1, wherein the shapes, the sizes, and the distributions of the cells are different from one face of the core to the other.

5. A racket according to claim 1, wherein the shapes, the sizes, and the distributions of the cells are different within a single face of the core.

6. A racket according to claim 1, wherein the core presents, as a single piece, a tubular handle and a paddle of thickness that is smaller than the smallest outside diametral dimension of the tubular handle, and provided with a plurality of recesses formed blind in the thickness of the paddle and opening out into the peripheral edge face thereof, and having their closed ends adjacent to a solid central portion of the paddle situated in line with the handle.

7. A racket according to claim 1, wherein the core presents, as a single piece, a tubular handle and a paddle provided with a plurality of recesses, at least some of which are through recesses being made on either side of a solid central portion of the paddle situated in line with the handle.

* * * * *